United States Patent [19]

Burton, III

[11] 4,181,362

[45] Jan. 1, 1980

[54] LIQUID SEAL FOR PRODUCTION LEVEL BULKHEAD FOR IN SITU OIL SHALE RETORT

[75] Inventor: Robert S. Burton, III, Grand Junction, Colo.

[73] Assignee: Occidental Oil Shale, Inc., Grand Junction, Colo.

[21] Appl. No.: 941,009

[22] Filed: Sep. 11, 1978

[51] Int. Cl.[2] ..... E21C 41/10

[52] U.S. Cl. ..... 299/2

[58] Field of Search ..... 299/2; 405/52-54, 405/59; 277/135

[56] References Cited

U.S. PATENT DOCUMENTS

| | | | |
|---|---|---|---|
| 3,123,977 | 3/1964 | Brode | 405/53 |
| 3,915,498 | 10/1975 | Burton et al. | 299/2 |
| 4,076,312 | 2/1978 | Cha et al. | 299/2 |

*Primary Examiner*—Ernest R. Purser

*Attorney, Agent, or Firm*—Christie, Parker & Hale

[57] ABSTRACT

An in situ oil shale retort is formed in a subterranean formation containing oil shale. The retort contains a fragmented permeable mass of formation particles containing oil shale. During retorting, oxygen-supplying gas is introduced into an upper level of the fragmented mass for establishing a combustion zone and for advancing the combustion zone through the fragmented mass. Liquid and gaseous products, including shale oil and off gas, are withdrawn from a sealed portion of a production level drift which extends laterally away from the lower level of the fragmented mass. A bulkhead sealed across the drift inhibits passage of off gas from behind the bulkhead to the portion of the drift on the side of the bulkhead opposite the fragmented mass. Off gas, shale oil and water are separately withdrawn from behind the bulkhead. A liquid level is maintained against the surface of the bulkhead facing the fragmented mass to seal the lower edge of the bulkhead and the drift floor adjacent the bulkhead against the passage of off gas through any rock fissures which can be present in the floor of the drift.

19 Claims, 1 Drawing Figure

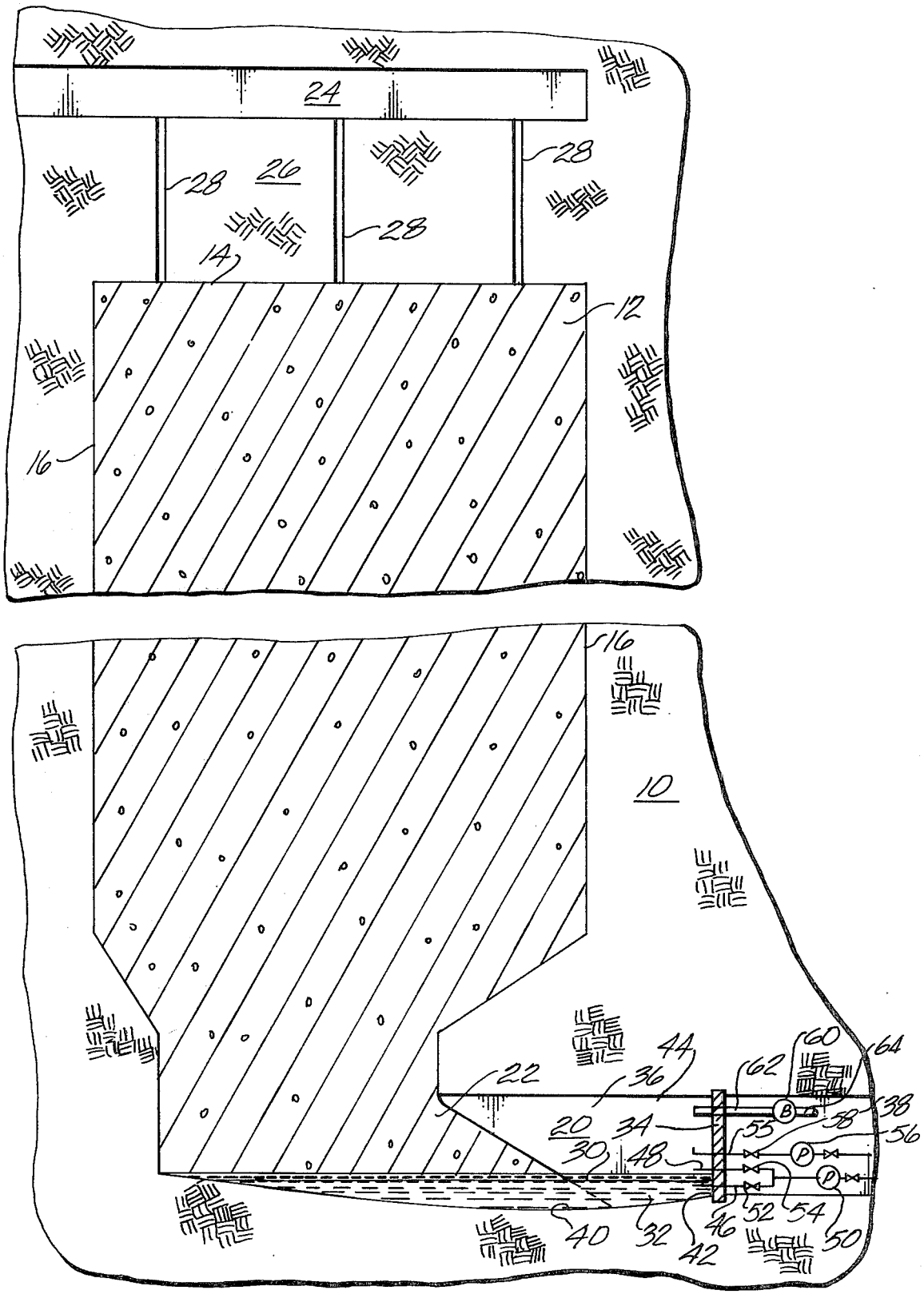
24
26
28
28
28
14
12
16
16
10
22
36
44
20
34
30
48
60
62
64
38
58
56
55
52
54
50
46
42
40
32

LIQUID SEAL FOR PRODUCTION LEVEL BULKHEAD FOR IN SITU OIL SHALE RETORT

BACKGROUND

This invention relates to recovery of liquid and gaseous products from subterranean formations containing oil shale, and more particularly, to techniques for providing a gas seal in a lower production level of an in situ oil shale retort.

The presence of large deposits of oil shale in the Rocky Mountain region of the United States has given rise to extensive efforts to develop methods for recovering shale oil from kerogen in the oil shale deposits. The term "oil shale" as used in the industry is in fact a misnomer; it is neither shale, nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein, and the liquid hydrocarbon product is called "shale oil".

A number of methods which have been proposed for processing oil shale involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. These patents describe in situ recovery of liquid and gaseous hydrocarbon materials from a subterranean formation containing oil shale wherein such formation is fragmented by explosive expansion techniques to form a stationary fragmented permeable mass of formation particles containing oil shale within the formation, referred to herein as an in situ oil shale retort.

In forming such a fragmented mass, at least one void is excavated from formation within the retort site, leaving a remaining portion of unfragmented formation within the retort site adjacent the void. Explosive is loaded into blasting holes drilled in the remaining portion of the unfragmented formation. The explosive is detonated for explosively expanding the remaining portion of unfragmented formation toward the free face of formation adjacent the void for forming a fragmented permeable mass of formation particles containing oil shale in an in situ oil shale retort.

During retorting, hot retorting gases are passed downwardly through the fragmented mass to convert kerogen contained in the oil shale to liquid and gaseous products, thereby producing retorted oil shale. One method of suppling hot retorting gases used for converting kerogen contained in the oil shale, as described in U.S. Pat. No. 3,661,423, includes establishing a combustion zone near the top of the fragmented mass and introducing an oxygen-supplying gaseous combustion zone feed into the fragmented mass to advance the combustion zone downwardly through the fragmented mass. In the combustion zone, oxygen in the combustion zone feed is depleted by reaction with hot carbonaceous materials to produce heat, combustion gas and combusted oil shale. By continued introduction of the combustion zone feed into the fragmented mass, the combustion zone is advanced through the fragmented mass.

The combustion gas and the portion of the combustion zone feed that does not take part in the combustion process pass through the fragmented mass on the advancing side of the combustion zone. This heats the oil shale in a retorting zone to a temperature sufficient to produce kerogen decomposition, called retorting, in the oil shale. The kerogen decomposes into gaseous and liquid products, including gaseous and liquid hydrocarbon products, and to a residual solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort. An off gas also is withdrawn from the bottom of the retort. The off gas contains combustion gas, including carbon dioxide generated in the combustion zone, gaseous products produced in the retorting zone, carbon dioxide from carbonate decomposition, and any gaseous retort inlet mixture that does not take part in the combustion process.

During retorting the liquid products and a process off gas containing gaseous products pass to a lower level of the fragmented mass. The liquid products include water and shale oil which can accumulate in the bottom of a production level drift at a lower level of the fragmented mass. The water and shale oil can be separately withdrawn through the production level drift. The process off gas also is withdrawn through the production level drift. The off gas can contain nitrogen, hydrogen, carbon monoxide, carbon dioxide, water vapor, methane and other hydrocarbons and sulfur compounds, such as hydrogen sulfide. Hydrogen sulfide and carbon monoxide are extremely toxic gases. These and other constituents are combustible. For this reason, the production level drift is sealed against the passage of off gas from the portion of the drift where the gas collects, so that workers in adjacent underground workings at the production level are isolated from the off gas collected in the production level drift. A bulkhead placed across the production level drift can provide such a gas seal.

Cracks or fissures can be present in the walls of unfragmented formation adjacent the production level drift. Such cracks or fissures can result from shock caused when explosive is detonated for excavating the production level drift.

It is desirable to seal the floor of the production level drift adjacent the production level bulkhead against the passage of off gas through any cracks or fissures which can be present in the drift floor. Such a gas seal can inhibit passage of toxic off gas into other underground workings.

SUMMARY OF THE INVENTION

This invention provides a gas seal for a production level of an in situ oil shale retort containing a fragmented permeable mass of formation particles containing oil shale. A production level drift is excavated laterally away from a lower production level of the fragmented mass. A bulkhead is placed across the production level drift for inhibiting gas flow from an inside portion of the drift adjacent the fragmented mass to an outside portion of the drift on the side of the bulkhead opposite the fragmented mass. A pool of liquid on the floor of the drift is maintained at a sufficient liquid level against the bulkhead for providing a gas seal across a lower inside edge of the bulkhead and along an inside portion of the drift floor adjacent the bulkhead. The liquid is impervious to gas flow and inhibits the passage of gas from the inside portion of the drift to the outside portion of the drift through any portion of the drift floor covered by liquid.

DRAWING

The features of a specific embodiment of the best mode contemplated for carrying out the invention are illustrated in the drawing which shows a fragmentary semi-schematic, cross-sectional side view of an in situ oil shale retort having a production level drift with a liquid level maintained adjacent a production level bulkhead for providing a gas seal according to principles of this invention.

DETAILED DESCRIPTION

The drawing shows an in situ oil shale retort formed in a subterranean formation 10 containing oil shale. The in situ oil shale retort includes a fragmented permeable mass 12 of formation particles containing oil shale. The fragmented mass 12 can be formed by conventional explosive expansion techniques wherein at least one void (not shown) is excavated from formation within the retort site, leaving a remaining portion of unfragmented formation adjacent such a void. Blasting holes (not shown) are then drilled in such remaining portion of unfragmented formation adjacent the void, and the blasting holes are loaded with explosive which is detonated for explosively expanding such remaining portion of formation toward such a void for forming the fragmented mass 12.

The fragmented mass 12 shown in the drawing is rectangular in horizontal cross-section and has a top boundary 14, four vertically extending side boundaries 16, and a lower boundary 18 which can taper narrower toward the bottom of the fragmented mass 12 for forming a bottom portion of the fragmented mass smaller in horizontal cross-section than the principal portion of the fragmented mass.

A drift 20 at a production level provides a means for access to the lower boundary of the fragmented mass 12. The production level drift 20 extends generally horizontally away from the bottom of the fragmented mass. During formation of the fragmented mass, formation particles 22 from the fragmented mass fall under gravity into an inside portion of the production level drift 20 at the bottom of the fragmented mass being formed.

The in situ oil shale retort can include an open base of operation 24 excavated on an upper working level. The floor of the base of operation 24 is spaced above the upper boundary 14 of the fragmented mass, leaving a horizontal sill pillar 26 of unfragmented formation between the bottom of the base of operation and the top boundary 14 of the fragmented mass. The base of operation 24 can provide effective access to substantially the entire horizontal cross-section of the fragmented mass. Such a base of operation provides an upper level means for access for excavating operations for forming a void and for drilling and explosive loading for explosively expanding formation toward such a void when forming the fragmented mass 12. The base of operation 24 also facilitates introduction of oxygen-supplying gas into the top of the fragmented mass 12 during retorting operations.

During retorting the fragmented formation particles at the top of the fragmented mass are ignited to establish a combustion zone in the top of the fragmented mass. Air or other oxygen-supplying gas can be supplied to the combustion zone from the base of operation 24 through vertical air passages 28 drilled downwardly from the base of operation through the sill pillar 26 to the top of the fragmented mass. Conduits can be installed in the vertical air passages 28 and gas flow control valves (not shown) in the base of operation 24 can be used for controlling the flow of oxygen-supplying gas through the respective conduits to the fragmented mass. Air or other oxygen-supplying gas introduced to the fragmented mass through such conduits maintain the combustion zone and advance it downwardly through the fragmented mass 12. Hot gas from the combustion zone flows through the fragmented mass on the advancing side of the combustion zone to form a retorting zone where kerogen in the fragmented mass is converted into liquid and gaseous products. As the retorting zone moves down through the fragmented mass, liquid and gaseous products are released from the fragmented formation particles. Liquid products, primarily shale oil 30 and liquid 32 containing water, produced during operation of the retort collect below the fragmented mass 12 in a lower portion of the production level drift 20. The liquid 32 containing water can include an emulsion of water and shale oil and is referred to below as water, for simplicity.

A bulkhead 34 is sealed across the production level drift at a location which is spaced apart longitudinally from the portion of the drift occupied by the fragmented formation particles forming the bottom of the fragmented mass. The production level drift 20 has a closed inside portion 36 on the side of the bulkhead 34 adjacent the fragmented mass 12 and an outside portion 38 on the side of the bulkhead opposite the fragmented mass 12. The outside portion 38 of the drift can be open to adjacent underground workings. The bulkhead can be steel and/or concrete and can be made to conform to the walls, roof, and floor of the drift, or preferably it can be formed in a notch or keyway extending into the unfragmented formation surrounding the drift. An inside edge 42 of the bulkhead extends across the juncture between the bulkhead and the floor 40 of the inside portion of the drift. The bulkhead also has an inside surface 44 facing toward the inside portion 36 of the production level drift. During retorting operations, the shale oil 30 and water 32 collect in the inside portion 36 of the production level drift behind the bulkhead. Off gas collects in an open space in the inside portion of the drift above the liquid level.

According to principles of this invention, a pool of liquid is maintained against the inside surface 44 of the bulkhead at a liquid level at least above the lower inside edge 42 of the bulkhead. In one embodiment wherein a depth of liquid is maintained against a lower portion of the bulkhead above the inside edge 42 of the bulkhead, the pool of liquid extends along the drift floor 40 continuously from the inside surface of the bulkhead for at least a portion of the lengthwise extent of the drift floor. Such a pool of liquid provides a gas impervious seal across the lower inside edge 42 of the bulkhead and the portions of the drift floor 40 below the liquid level. Such a gas impervious seal can seal against the passage of off gas from the inside portion 36 of the drift through any cracks or rock fissures present in formation forming the drift floor in the vicinity of the bulkhead below the liquid level. The liquid is more impervious to gas flow and therefore provides a more effective gas-tight seal against leakage of off gas than formation which is directly exposed to such off gas.

In one embodiment, the gas seal is constantly provided during retorting operations by maintaining the level of the water in the lower portion of the drift above the lower inside edge 42 of the bulkhead. The water and the shale oil 30 are separately withdrawn from the inside portion 36 of the drift as they collect in the drift during retorting operations. The shale oil 30 and water are withdrawn so that the water is constantly maintained at a level at least above the lower inside edge 42 of the bulkhead, at least as long as off gas is present in the inside portion of the drift. The water is withdrawn from behind the bulkhead by a lower water withdrawal line 46 extending through a sealed opening in a lower portion of the bulkhead and an upper water withdrawal line 48 extending through a separate sealed opening in the bulkhead with an intake at a level above the intake of the lower water withdrawal line 46. Both water withdrawal lines 46, 48 are connected to a water pump 50. Lower and upper water control valves 52 and 54, are respectively used to control flow of water through the lower and upper water withdrawal lines 46,48 respectively.

Shale oil is withdrawn from behind the bulkhead by an oil withdrawal line 55 which extends through a sealed opening in the bulkhead and has an intake above the intake of the upper water withdrawal line 48. The shale oil withdrawal line 55 is connected to an oil pump 56. An oil flow control valve 58 controls the flow of shale oil through the oil withdrawal line. The locations of the upper water withdrawal line 48 and the oil withdrawal line 55 are exaggerated in the drawing for clarity, since these lines are actually closer to the bottom of the bulkhead than shown.

Shale oil and water are each allowed to collect at desired levels behind the bulkhead 34 and are periodically withdrawn from the drift, as desired. The oil and water pumps, as well as the water and oil flow control valves, can be operated manually or by automatic controls (not shown) to remove the shale oil and water separately from behind the bulkhead.

The inlet of a blower 60 is connected by a conduit 62 to an opening sealed through the bulkhead 34 for withdrawing off gas which collects above the shale oil in the inside portion 36 of the drift. The outlet of the blower 60 delivers off gas from behind the bulkhead through a conduit 64 to a recovery or disposal system (not shown). The sizes of the conduits illustrated are smaller than actual for ease of illustration. It will also be understood that the off gas blower 60 can be located outside the underground workings rather than in the drift adjacent the retort.

In one method of withdrawing liquid, shale oil can be withdrawn from behind the bulkhead through the oil withdrawal line 55 until gas is sucked in through the line, indicating that the liquid level has reached the level of the oil withdrawal line. Shale oil and water can then be allowed to collect in the drift until more shale oil can be withdrawn through the oil withdrawal line. If water is withdrawn through the shale oil withdrawal line (as indicated by a densitometer (not shown) connected to the oil withdrawal line), then the water pump 50 is used to withdraw water from behind the bulkhead through either of the water withdrawal lines, until shale oil can be withdrawn through the oil withdrawal line.

Water can be withdrawn from behind the bulkhead either through both the lower and upper water withdrawal lines 46, 48 or separately through either of the water withdrawal lines. The intake of the lower water withdrawal line 46 is at a level spaced above the lower inside edges 42 of the bulkhead. In one method of withdrawing liquid, the lower water withdrawal line 46 can be used to withdraw water from behind the bulkhead until gas is sucked in through the line (indicating that the liquid level has reached the level of the lower water withdrawal line), or until shale oil is withdrawn through the lower water withdrawal line (as indicated by a densitometer (not shown) connected to the lower water withdrawal line). When either gas or shale oil is drawn through the lower water withdrawal line, pumping operations are stopped, and more shale oil and water are allowed to collect above the water level until it is desired to withdraw more shale oil and water. This procedures constantly leaves a pool of water above the floor of the drift and against the inside face 44 of the bulkhead at least at the level of the lower water withdrawal line 46, which provides a constant gas seal, during retorting across the portions of the drift floor and the lower inside edge 42 of the bulkhead below the water.

In the embodiment shown in the drawing, a pool of liquid is maintained above substantially the entire length of the floor 40 which extends below an open space in which off gas can collect behind the bulkhead. The lower water withdrawal line 46 is located in the bulkhead at a sufficient elevation above the highest level of the drift floor that a liquid level can be maintained above the drift floor for substantially the entire length of the drift floor behind the bulkhead. Since the entire portion of the drift floor which potentially could be exposed to off gas is sealed from such off gas by the liquid in the bottom of the drift, off gas leakage through the drift floor from the inside portion 36 of the drift to the outside portion 38 of the drift is inhibited.

The lower water withdrawal line 46 is also located at a sufficient level above the drift floor that a liquid level can be maintained above the drift floor to cover a substantial portion of the width of the drift floor at least adjacent the bulkhead. In one embodiment, a substantial portion of the width of the drift floor is covered with a depth of liquid above essentially the entire length of the floor below an open space in which off gas can collect behind the bulkhead. This inhibits leakage of off gas through a substantial portion of the drift floor area which could otherwise be exposed to off gas.

Before retorting is commenced, liquid is added to the inside portion of the drift to form a pool that seals the lower edge of the bulkhead. For example, water can be pumped in through one of the withdrawal lines to bring the water depth up to the desired level. Once liquid products begin to collect at the bottom the pool is maintained by withdrawing liquid only down to the selected level that maintains the gas seal.

Thus, the present invention provides a gas seal in a lower production level of an in situ oil shale retort. The gas seal is provided by maintaining a gas impervious liquid pool behind the production level bulkhead, which seals against the passage of off gas through any cracks or fissures which can be present in the floor of the drift behind the bulkhead. The liquid seal can be constantly maintained during retorting operations by allowing liquid products of retorting, primarily shale oil and water, to collect behind the bulkhead and above the drift floor during retorting operations. Shale oil and water are intentionally withdrawn from behind the bulkhead, but only to the extent that a minimum depth of liquid can be constantly maintained against the inside face 44 of the bulkhead, above the lower inside edge 42 of the bulkhead and above the drift floor adjacent the bulkhead. The minimum depth of liquid is maintained throughout the active life of the retort.

What is claimed is:

1. A liquid seal for closing the bottom of an in situ oil shale retort containing a fragmented permeable mass of formation particles containing oil shale comprising:

a drift extending laterally away from a lower level of the fragmented mass;

a bulkhead placed across the drift for inhibiting gas flow from an inside portion of the drift adjacent the fragmented mass to an outside portion of the drift on a side of the bulkhead opposite the fragmented mass, the bulkhead having a lower edge extending across a floor of the drift; and a pool of liquid on the floor of the drift maintained at a sufficient level against the surface of the bulkhead to seal the lower edge of the bulkhead against the passage of gas from the inside portion of the drift to the outside portion of the drift.

2. A liquid seal according to claim 1 including a liquid withdrawal line sealed through the bulkhead and having an intake located in the inside portion of the drift at a selected level above the lower edge of the bulkhead; and means for withdrawing liquid from the inside portion of the drift through the liquid withdrawal line.

3. A liquid seal according to claim 2 wherein the drift extends away from a side portion of the fragmented mass; and wherein the intake of the liquid withdrawal line is located at a sufficient level above the floor of the inside portion of the drift that liquid at the level of the intake maintains a pool of liquid above the floor between the inside of the bulkhead and the side portion of the fragmented mass.

4. A liquid seal according to claim 3 including an off gas withdrawal line extending through the bulkhead for withdrawing off gas from the inside portion of the drift at a level above the liquid.

5. A liquid seal according to claim 2 wherein the intake of the liquid withdrawal line is located at a sufficient level above the floor of the inside portion of the drift that liquid at the level of the intake provides a pool of liquid above the drift floor across a substantial portion of the drift between the inside surface of the bulkhead and the fragmented mass.

6. A liquid seal according to claim 1 comprising a water withdrawal line having an intake in the inside portion of the drift at a selected level above the lower edge of the bulkhead; means for withdrawing water from the inside portion of the drift through the water withdrawal line; a shale oil withdrawal line having an intake above the intake of the water withdrawal line for withdrawing shale oil which collects above a water level maintained in the inside portion of the drift; and means for withdrawing shale oil from the inside portion of the drift through the shale oil withdrawal line.

7. A liquid seal according to claim 1 wherein the drift extends away from a side portion of the fragmented mass; and including means for maintaining the body of liquid at a level above the floor of the inside portion of the drift for at least a substantial portion of the distance between the side of the fragmented mass and the inside surface of the bulkhead.

8. A liquid seal according to claim 1 including an off gas withdrawal line extending through the bulkhead for withdrawing off gas from the inside portion of the drift.

9. An in situ oil shale retort comprising:

a fragmented permeable mass of formation particles containing oil shale;

a drift extending laterally away from a lower level of the fragmented mass;

a bulkhead placed across the drift to seal against gas flow from an inside portion of the drift adjacent the fragmented mass to an outside portion of the drift on the side of the bulkhead opposite the fragmented mass, the bulkhead having a lower inside edge at a juncture between the bulkhead and a floor of the inside portion of the drift, the bulkhead having an inside surface facing toward the inside portion of the drift;

a pool of liquid on the floor of the inside portion of the drift; and means for maintaining the pool of liquid at no less than a selected level against the inside surface of the bulkhead above the lower inside edge of the bulkhead with the liquid level extending along the drift above the drift floor from the inside surface of the bulkhead toward the fragmented mass to seal the lower inside edge of the bulkhead and at least a portion of the drift floor adjacent the bulkhead against the passage of gas from the inside portion of the drift to the outside portion of the drift.

10. A retort according to claim 9 wherein the drift extends away from a side portion of the fragmented mass; and including means for maintaining the pool of liquid at said selected level above the floor of the drift for at least a substantial portion of the distance between the side portion of the fragmented mass and the inside surface of the bulkhead.

11. A retort according to claim 9 including a water withdrawal line sealed through the bulkhead and having a water intake in the inside portion of the drift substantially at said selected level.

12. A retort according to claim 11 including an oil withdrawal line sealed through the bulkhead and having an oil intake in the inside portion of the drift above the level of the water intake.

13. A retort according to claim 12 in which the drift extends away from a side portion of the fragmented mass; and wherein the water intake of the water withdrawal line is located at a sufficient level that water at the level of the water intake can provide a continuous liquid pool above the drift floor between the inside surface of the bulkhead and the side portion of the fragmented mass.

14. A method for closing the bottom of an in situ oil shale retort in a subterranean formation containing oil shale, the in situ retort containing a fragmented permeable mass of formation particles containing oil shale, the method comprising the steps of:

excavating a drift in the subterranean formation such that the drift extends laterally away from a lower level of the fragmented mass;

placing a bulkhead across the drift for providing a closed inside portion of the drift between the bulkhead and the fragmented mass for collecting liquid and gaseous products from the fragmented mass during retorting operations in the fragmented mass and for sealing against the passage of off gas to an outside portion of the drift on a side of the bulkhead opposite the fragmented mass; and maintaining a pool of liquid on the floor of the drift at a sufficient liquid level against the surface of the bulkhead adjacent the inside portion of the drift for sealing the lower edge of the bulkhead adjacent the floor of the drift and a portion of the drift floor adjacent the bulkhead against the passage of gas from the inside portion of the drift to the outside portion of the drift.

15. A method according to claim 14 including introducing an oxygen-supplying gas into an upper of the fragmented mass for sustaining a combustion zone in the fragmented mass and for advancing the combustion zone through the fragmented mass for retorting oil shale and producing liquid and gaseous products; collecting such liquid products in the pool in the inside portion of the drift; and withdrawing off gas from the inside portion of the draft.

16. A method according to claim 15 including placing liquid in the pool prior to establishing the combustion zone in the fragmented mass.

17. In a method for recovering liquid and gaseous products from an in situ oil shale retort in a subterranean formation containing oil shale comprising: forming an in situ oil shale retort containing a fragmented permeable mass of particles containing oil shale; forming a drift extending laterally away from a lower level of the fragmented mass; placing a bulkhead across the drift for inhibiting gas flow from an inside portion of the drift adjacent the fragmented mass to an outside portion of the drift on the side of the bulkhead opposite the fragmented mass, the bulkhead having a lower edge extending across the floor of the drift; establishing a combustion zone in an upper portion of the fragmented mass; introducing an oxygen-supplying combustion zone feed into the fragmented mass for advancing the combustion zone downwardly through the fragmented mass, thereby retorting oil shale on the advancing side of the combustion zone and producing liquid and gaseous products; and withdrawing an off gas including such gaseous products through such bulkhead, the improvement comprising:

collecting liquid products in the inside portion of the drift adjacent the lower portion of the fragmented mass and maintaining a sufficient depth of liquid in said drift to form a gas seal along the lower edge of the bulkhead.

18. A method according to claim 17 including withdrawing liquid products from the inside portion of the drift while maintaining a sufficient depth of liquid on the floor of the drift to seal the lower edge of the bulkhead and a substantial portion of the floor of the drift adjacent the bulkhead against the passage of gas from the inside portion of the drift to the outside portion of the drift.

19. A method according to claim 17 including placing a pool of liquid in the drift to form a gas seal along the lower edge of the bulkhead prior to establishing the combustion zone in the fragmented mass.

* * * * *